US005984711A

United States Patent [19]

Woodard

[11] Patent Number: 5,984,711

[45] Date of Patent: Nov. 16, 1999

[54] METHODS AND APPARATUS FOR INCREASING WIRE DIAMETER TO IMPROVE CONNECTABILITY

[75] Inventor: Robert E. Woodard, Hayward, Calif.

[73] Assignee: Scimed Life Systems, Inc., Maple Grove, Minn.

[21] Appl. No.: 09/150,989

[22] Filed: Sep. 10, 1998

[51] Int. Cl.[6] ..... H01R 4/24

[52] U.S. Cl. ..... 439/395; 29/257

[58] Field of Search ..... 439/395, 396, 439/408, 443; 174/74 R, 74 A, 75 B, 78; 29/857

[56] References Cited

U.S. PATENT DOCUMENTS

| | | | |
|---|---|---|---|
| 3,367,339 | 2/1968 | Sessions | 607/129 |
| 3,920,301 | 11/1975 | Roberts et al. | 439/492 |
| 4,428,115 | 1/1984 | Campbell et al. | 29/873 |
| 5,295,868 | 3/1994 | Viaud et al. | 439/610 |
| 5,894,104 | 4/1999 | Hedberg | 174/36 |

*Primary Examiner*—Neil Abrams
*Assistant Examiner*—Michael C. Zarroli
*Attorney, Agent, or Firm*—Lyon & Lyon LLP

[57] ABSTRACT

Methods and apparatus for connecting relatively small wires to standard size electrical connectors. An enlarged conductive region is formed on an end of the wire, the conductive region having an outer dimension adapted to be securely received in the connector, and the enlarged conductive region is covered with a nonconductive sleeve to electrically isolate the conductive region, the conductive region and nonconductive sleeve together defining an enlarged connector lead. The enlarged conductive region may be a conductive tube through which the wire is inserted and then spot welded, folded and/or crimped, or a multiple folded segment of the wire end, covered by a nonconductive shrink tube. The resulting enlarged connector lead may be received in a standard insulation displacement connector as part of a system for coupling the wire to electrical circuitry, the connector including a blade for piercing the nonconductive sleeve to electrically couple the wire to a terminal on the connector.

32 Claims, 3 Drawing Sheets

METHODS AND APPARATUS FOR INCREASING WIRE DIAMETER TO IMPROVE CONNECTABILITY

FIELD OF THE INVENTION

The present invention relates generally to electrical connectors, and more particularly to methods and apparatus for connecting relatively small electrical wires to larger connectors or wires.

BACKGROUND

Small diameter catheters, such as diagnostic or therapeutic electrophysiology catheters, may be introduced into a patient's body in order to position a plurality of electrodes and/or sensors distally located on the catheter at a selected internal body location. Generally, such catheters have an elongate shape, terminating in a distal end, and having a size to facilitate introduction into the body, for example, through the cardiovascular system to a selected location within a heart chamber.

To couple electrodes carried on the distal end of the catheter to external circuitry, such as a source of energy and/or a processor for receiving or analyzing data from the electrodes, a plurality of respective electrode wires or leads are provided. The electrode wires are connected to respective electrodes on the distal end of the catheter and extend through a lumen inside the catheter to its proximal end. The electrode wires exiting the proximal end of the catheter are typically attached to external connectors, which are adapted for coupling to external circuitry.

Due to the limited space available within the catheters, the electrode wires are generally substantially smaller in diameter than wire used for standard external electrical cables and connectors. For example, an electrophysiology catheter may carry a significant number of electrode wires (e.g. sixty four) in a single relatively small lumen, wherein a wire diameter as small as between about 36 and about 46 gauge is required to fit the respective electrode wires in the lumen. On the other hand, conventional external cable systems are generally adapted for connecting substantially larger wires, for example 24–28 gauge wire.

Ribbon cables, which carry a plurality of discrete wires in a planar arrangement, are often used to connect a variety of standard electrical or electronic components. Ribbon cables, however, are generally incompatible with the small size and shape of the available wire lumen provided in an electrophysiology catheter.

In addition, insulation displacement connectors are a convenient and inexpensive connector often used to mechanically provide an electrical connection between such ribbon cables and other circuitry. These devices typically include a bank of slots for receiving standard size wires, e.g. 24–28 gauge insulated wires, where an individual wire may be mechanically secured within each slot such that a blade in the slot penetrates the insulation to provide an electrical connection.

Such inexpensive commercially available connectors, however, do not have slots that are capable of securely receiving relatively small size wires, e.g., those between about 36 and about 46 gauge, as may be appropriate for the above-described electrode wires in electrophysiology catheters. Instead, to provide a connection between electrode wires and conventional external circuitry, the small size electrode wires must be individually soldered or otherwise individually connected to conventional large wires or connectors. For example, individual electrode wires may be soldered or crimped to 2 mm diameter pins, or they may be placed into "cups" on a connector, such as a "LEMO" style connector, and soldered or adhered with a conductive epoxy.

In addition to the relatively costly procedure of individually connecting the "smaller" electrode wires to the "larger" ribbon cable wires, because of their relatively small size, the electrode wires are often very fragile and/or prone to fatigue. Consequently, the resulting soldered joints tend to be fragile and vulnerable to breaking during the use of the catheters.

Accordingly, there is a need for an improved method for connecting small gauge electrode wires to standard size wires and/or external circuitry.

SUMMARY OF THE INVENTION

The present invention is directed to methods and apparatus for increasing the size of relatively small insulated wires, such as those used in electrophysiology devices, in order to facilitate their connection to standard size external connectors and/or electrical circuitry.

In a preferred embodiment, an apparatus for connecting a relatively small diameter wire to a standard size electrical connector includes an enlarged conductive region formed on an end of the wire, the conductive region having an outer dimension adapted to be securely received in the connector. A nonconductive sleeve is disposed over the conductive region, the conductive region and nonconductive sleeve collectively forming an enlarged connector lead. The nonconductive sleeve substantially electrically isolates the conductive region and is penetrable to allow for the conductive region to be electrically coupled to the connector.

By way of one preferred example, the enlarged conductive region comprises a conductive tube, such as a hypotube, attached to the end of the wire, with the nonconductive sleeve comprising a section of nonconductive shrink tubing. In an alternate example, the enlarged conductive region comprises a multiple folded segment of the wire end, preferably folded so as to have a hexagonal cross-section, which is then packed into a nonconductive shrink tube. Preferably, the enlarged conductive region has an outer dimension equivalent to a wire gauge size in a range from about 24 gauge to about 28 gauge in accordance with standard electrical connectors.

Advantageously, the enlarged connector lead may be included as part of a system for coupling an electrode wire extending from an electrophysiology device to external electrical circuitry via a standard wire connector. For example, an insulation displacement connector may be provided, the connector having a slot for receiving an insulated wire having a predetermined size, the electrode wire having a size substantially smaller than the predetermined size. The connector also includes a cover for securing the insulated wires in the slot, and a blade for penetrating insulation on the insulated wire received in the slotted pin to provide an electrical connection between the insulated wire and a terminal on the connector.

An enlarged conductive region is formed on an end of the electrode wire, the enlarged conductive region having a size substantially similar to the predetermined size whereby the enlarged conductive region is securely receivable within the slot. A nonconductive sleeve is disposed on the enlarged conductive region substantially surrounding and electrically isolating the enlarged conductive region.

The resultant enlarged connector lead may be inserted into the slot, and the cover closed, to thereby secure the enlarged connector lead in the slot. When secured in the slot, the enlarged conductive region may be crimped and/or deformed slightly to secure the enlarged connector lead in the connector. As the enlarged connector lead is secured in the slot, the blade on the connector pierces the nonconductive sleeve to electrically couple the electrode wire to a terminal on the connector. In this manner, a standard size mechanical connector may be employed to connect relatively small electrode wires to external circuitry, thereby avoiding individually soldering and/or other difficult or relatively expensive connection methods.

Other objects and features of the present invention will become apparent from consideration of the following description taken in conjunction with the accompanying drawings.

DETAILED DESCRIPTION OF THE PREFERRED EMBODIMENTS

Figure 1:
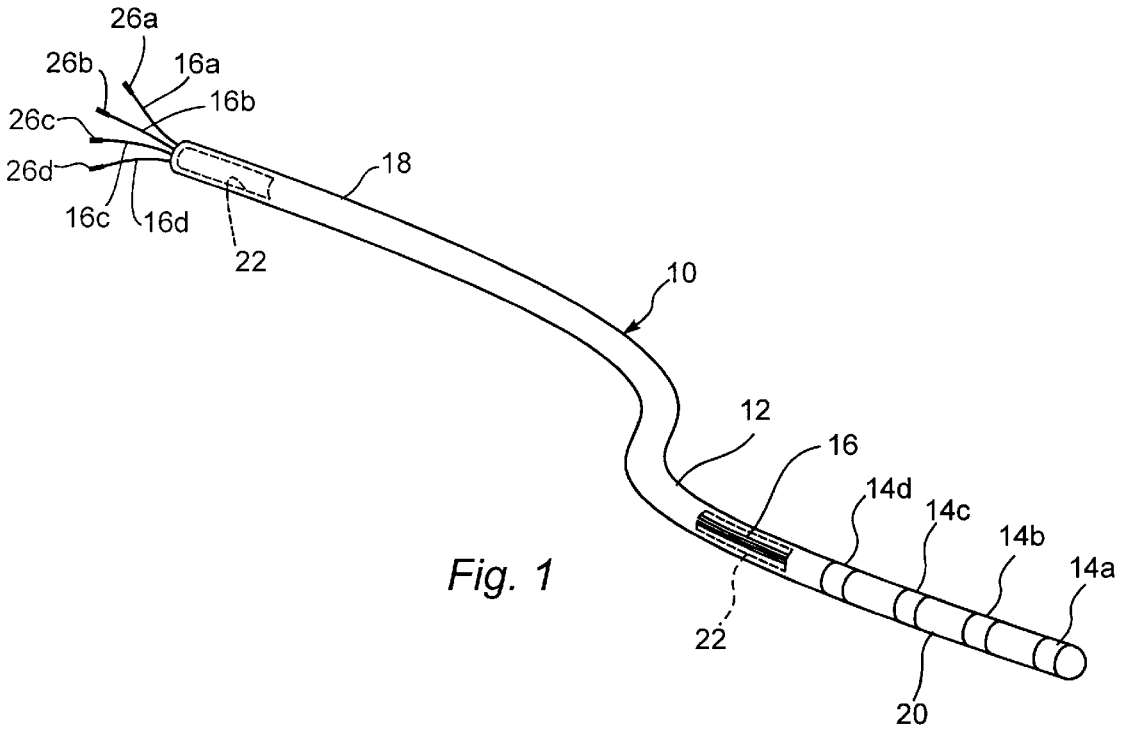
FIG. 1 is a perspective view of an electrophysiology catheter with a plurality of electrodes, electrode wires, and enlarged connector leads.

Turning now to the drawings, FIG. 1 shows a preferred embodiment of a catheter 10 having enlarged electrode wire connector leads 26 in accordance with the present invention. The catheter 10 includes an elongate flexible body 12 having a proximal end 18, a distal end 20 and a lumen 22 (shown in phantom) extending therebetween. A plurality of electrodes 14 are provided on the distal end 20, the electrodes possibly being ablation and/or sensing electrodes, thermocouples and the like. Four electrodes 14*a*–14*d* are shown for illustrative purposes, however any number of electrodes may be provided, with between two and ten electrodes being preferred. The catheter 10 may also include other components, such as a handle, a steerable distal tip, and/or a control mechanism (not shown), as will be appreciated by those skilled in the art.

For each of the electrodes 14, a wire or electrode wire 16 extends proximally from the distal end 20 through the lumen 22 and exits the proximal end 18 for connection to external circuitry (not shown). The electrode wires 16 are relatively small gauge wires, for example as compared to standard electrical wires or cables commonly used in the computer or electronic industries, to facilitate introduction of a plurality of the electrode wires 16 through the lumen 22, with wire within a range from about 36 gauge to about 38 gauge being preferred.

Figure 2A:
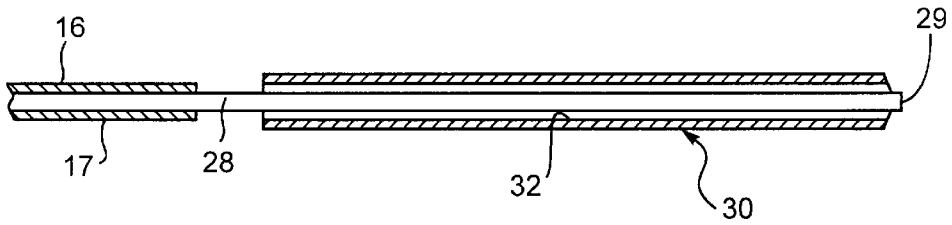
FIG. 2A is a cross-sectional side view of an individual electrode wire having a conductive tube attached to it.
Figure 2B:
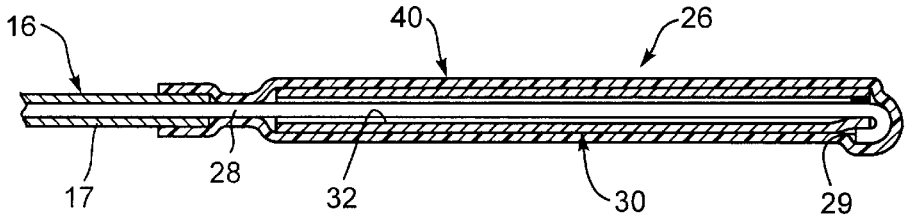
FIG. 2B is a cross-sectional side view of the electrode wire and conductive tube of FIG. 2A, with a nonconductive sleeve covering the conductive tube to provide an enlarged connector lead in accordance with the present invention.

Turning to FIGS. 2A and 2B, a first preferred embodiment of an enlarged connector lead 26 is shown that is formed on a proximal end 28 of an electrode wire 16 to facilitate electrically connecting an electrode coupled to the electrode wire 16 to conventional electronic circuitry (not shown). Preferably, the enlarged connector lead 26 is formed on the proximal end 28 to increase the diameter of the electrode wire 16 to that of standard electrical connectors and/or wire, preferably in a range from about 24 gauge to about 28 gauge, such that the enlarged connector lead 26 may be connectable to a standard insulation displacement connector ("IDC") (not shown in FIGS. 2A and 2B).

The enlarged connector lead 26 includes a conductive tube 30 having an outer diameter similar to that of standard 24–28 gauge wire, and a thin nonconductive sleeve 40 substantially surrounding the conductive tube 30. The conductive tube 30 has a passage 32 extending axially therethrough, through which the proximal end 28 of the electrode wire 16 is inserted. The electrode wire 16 is substantially permanently attached to the conductive tube 30, for example, by soldering or spot welding a proximal tip 29 of the electrode wire 16 to the conductive tube (see FIG. 2A), by folding the proximal tip 29 over the conductive tube 30 (see FIG. 2B), and/or by crimping the conductive tube 30 to frictionally engage the electrode wire 16 therein (see FIG. 2B).

Preferably, the conductive tube 30 is a predetermined length of hypotube, e.g. about one inch in length, that is formed from a conductive material, such as copper, stainless steel, gold, or plated with such a conductive material. For example, a 27 gauge RW (regular wall) hypotube, which has inside and outside diameters of 0.008 inch and 0.016 inch, respectively, is particularly useful for connector leads in accordance with the present invention.

The nonconductive sleeve 40 is a thin-walled tubular sleeve that substantially covers or envelops the conductive tube 30 to electrically isolate the lead 26. Preferably, the nonconductive sleeve 40 is a section of shrink tubing, formed for example from polyolefin or Teflon, that is sufficiently soft that the nonconductive sleeve 40 may be penetrated or pierced when received in an insulation displacement connector as described further below. For example, shrink tubing having an expanded, i.e. preshrunk, inside diameter of about 0.030 inch or more, and a recovered, i.e. shrunk, inside diameter of about 0.020 inch or less, and preferably about 0.016 inch or less, is illustrative of an appropriate material to provide the nonconductive sleeve 40 with an outside diameter of about 0.050 inch when shrunk over the conductive tube 30.

The enlarged connector lead 26 is formed on the proximal end 28 of the electrode wire 16 by a method that substantially eliminates the precise soldering that is often used in conventional methods to attach electrode wires 16 to external circuitry. After the catheter 10, electrodes 14 and electrode wires 16, are assembled in a conventional manner, the proximal ends 28 of the electrode wires 16 exit from the proximal end 18 of the catheter 10. The length of each electrode wire 16 is preselected such that each proximal end 28 extends a predetermined distance expected between the catheter 10 and a connector (not shown) plus about one inch.

The proximal ends 28 of the electrode wires 16 are separated and identified with respective electrodes, such as the electrodes 14*a*–14*d* and the corresponding electrode wires 16*a*–16*d* shown in FIG. 1. Insulation 17 is stripped from the proximal end 28 of each electrode wire 16, preferably to expose about one inch, or slightly more than one inch, of bare wire.

As shown in FIG. 2A, the proximal end 28 of the electrode wire 14 is inserted through the passage 32 in the conductive tube 30, and attached to the conductive tube 30, preferably by folding, spot welding, and/or crimping the distal tip 29 to the conductive tube 30. Any excess of the proximal end 28 of the electrode wire 14 extending through the conductive tube 30 may be cut off, if desired, after the conductive tube 30 is attached. Thus, the conductive tube 30 is electrically coupled to the electrode wire 14, and consequently the corresponding electrode 16 (see FIG. 1).

As shown in FIG. 2B, the nonconductive sleeve 40, in its expanded form (not shown) is then directed over the conductive tube 30, and heated or otherwise made to recover. The nonconductive sleeve 40 shrinks or is otherwise secured to envelop the conductive tube 30 and the bare proximal end 28, and thereby electrically isolate the electrode wire 14. The process is repeated, for example as shown in FIG. 1, for each electrode wire 16*a*–16*d* to produce a set of enlarged connector leads 26*a*–26*d*.

Turning to FIGS. 3A–3C and 4, the enlarged connector leads 26*a*–26*d* of the catheter 10 may then easily be attached to a standard electrical connector, such as an insulation displacement connector 50, using a simple mechanical fit, i.e. without soldering or bonding with adhesives. The insulation displacement connector 50 may be a conventional IDC-style connector, preferably a ribbon connector, such as AMP Part Number 499997-1, manufactured by AMP Incorporated of Harrisburg, Pa., or similar products made by Amphenol Corporation of Wallingford, Conn. The connector 50 has a base 52 including a plurality of slotted pins 54, each for receiving an insulated wire having a predetermined diameter, preferably between 24 and 28 gauge insulated wire. The slotted pins 54 each preferably have a "U" shape to define a slot 56 having a blade 58 therein. The slotted pins 54 are preferably electrically conductive and are coupled to individual terminals 60 or other conventional pins or sockets on the connector 50.

The connector 50 includes a cover 62 that may be snapped or otherwise attached to the base 52, to secure individual insulated wires within respective slots 56. The cover 62 substantially engages the slots 56 to thereby cause the blades 58 to pierce the insulation on the insulated wires and thereby create electrical connections between the individual insulated wires and their respective terminals 60 on the connector 50.

Figure 3C:
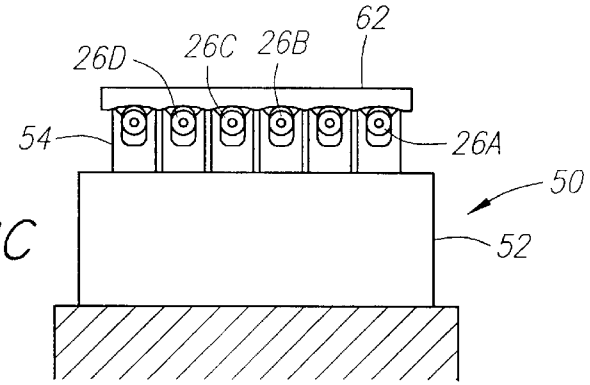
FIG. 3C is an end view of the insulation displacement connector and the enlarged connector leads of FIG. 3A.
Figure 3A:
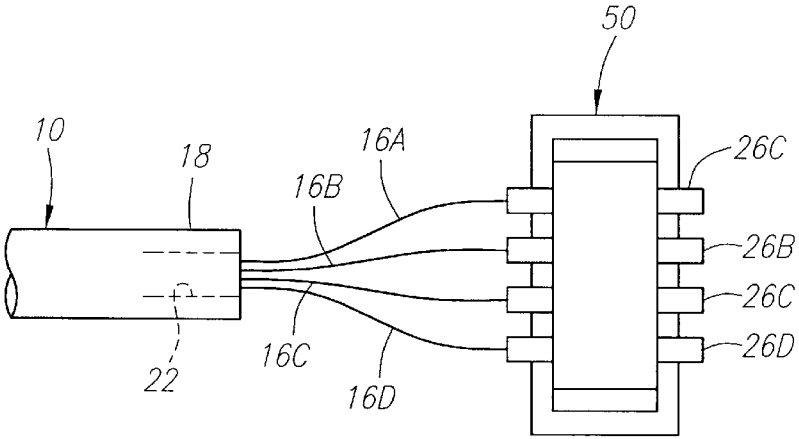
FIG. 3A is a top view of a proximal end of the catheter of FIG. 1, with the enlarged connector leads received in an insulation displacement connector.
Figure 3B:
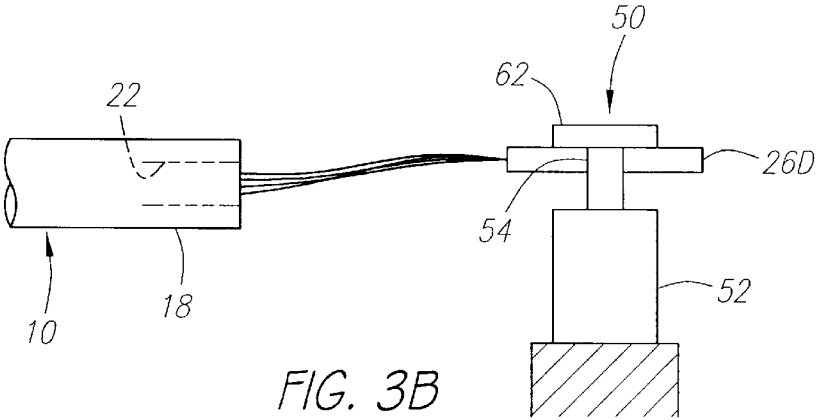
FIG. 3B is a side view of the proximal end of the catheter, the insulation displacement connector, and the enlarged connector leads of FIG. 3A.

With particular reference to FIGS. 3A–3C, the enlarged connector leads 26*a*–26*d* may be directed into the respective slotted pins 56*a*–56*d*, and the cover 62 may be attached to the base 52. This secures the enlarged connector leads 26*a*–26*d* within the slotted pins 56*a*–56*d*.

Figure 4:
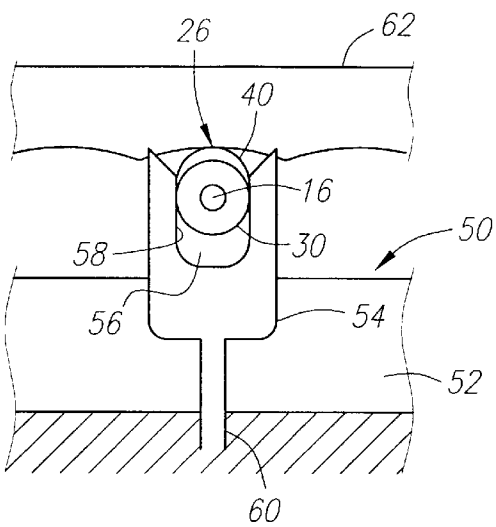
FIG. 4 is a detail of the insulation displacement connector of FIG. 3C, showing a slotted pin receiving an enlarged connector lead, and a blade for penetrating a nonconductive sleeve on the enlarged connector lead.

As best seen in FIG. 4, the conductive tube 30 of each enlarged connector lead 26 may be slightly crimped or deformed when received in the slotted pin 56. The blade 58 is forced into contact with the enlarged connector lead 26, penetrating the nonconductive sleeve 40, and thereby electrically contacting the conductive tube 30. The terminals 60 on the connector 50 are preferably pins or sockets embedded in the connector 50 on a side opposite the blade 58, which are configured to connect to a cable, a PC board, or other electronic equipment, as will be appreciated by those skilled in the art. Thus, when the enlarged connector leads 26 are snapped into the slotted pins 54, the terminals 60 of the connector 50 are electrically coupled to respective electrode wires 16 and consequently to respective electrodes 14 on the catheter 10.

Accordingly, in accordance with the present invention, a method is provided for forming enlarged connector leads for small diameter wires, such as electrode wires, to facilitate their connection to standard size electrical connectors and/or circuitry. Preferably, the enlarged connector leads allow the wires to be connected to standard, inexpensive mechanical connectors, such as an IDC. The method may increase manufacturing efficiency, by substantially eliminating soldering of individual small diameter wires to small connector pins, as well as possibly reducing the cost of the connectors used to connect the wires to external circuitry.

Figure 5A:
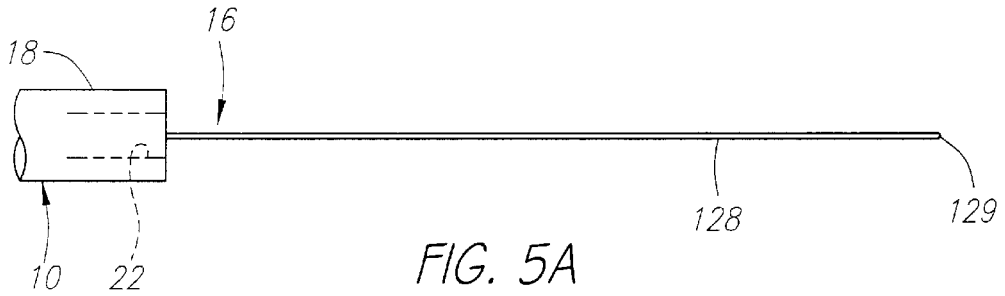
FIGS. 5A–5D are a series of schematic views, showing the folding sequence to form a multiple folded conductive segment for an enlarged connector lead in accordance with an alternative embodiment of the present invention.
Figure 5B:
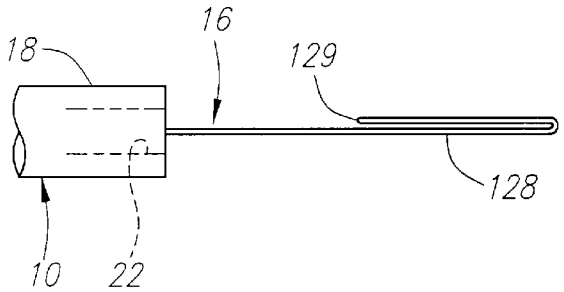
Figure 6:
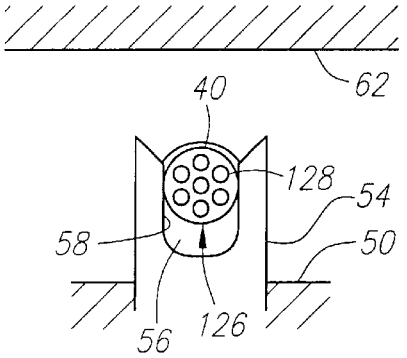
FIG. 6 is a cross-sectional detail of an enlarged connector lead including the multiple folded conductive segment of FIG. 5 being received in a slotted pin on an insulation displacement connector.

Turning to FIGS. 5A–5B and 6, an alternate embodiment of an enlarged connector lead 126 in accordance with the present invention is shown. The enlarged connector lead 126 includes a multiple folded conductive segment 130 on a proximal end 28 of an electrode wire 16, and a nonconductive sleeve 40 covering the multiple folded conductive segment 130. The enlarged connector lead 126 may be received in a slotted pin 54 similar to the embodiment previously described, to couple the electrode wire 16 to a terminal 60 on the connector 50.

In this embodiment, the conductive segment 130 is formed directly from an extra long proximal end 128 of the electrode wire 16, rather than by attaching a separate conductive tube. To form the enlarged connector lead 126, the catheter (not shown) is assembled, and each electrode wire 16 is separated, as previously described. The length of each electrode wire 16 exiting from the proximal end of the catheter, however, is about eight inches longer than the distance expected between the catheter and the connector (not shown).

Figure 5C:
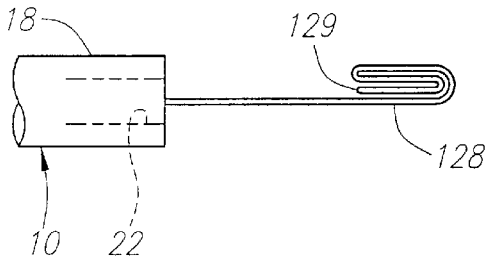
Figure 5D:
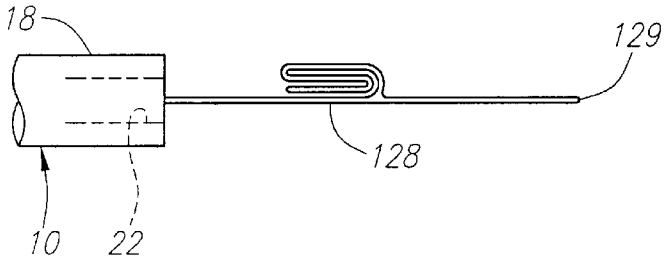

The proximal-most segment 128*a* of the electrode wire 16 may be stripped of its insulation 17 to identify each individual wire, e.g., during separation above, and/or to facilitate assembly, although preferably, the electrode wire 16 does not need to be stripped prior to assembly. The proximal end 128 is then folded in half twice successively, as shown in FIGS. 5B and 5C respectively. Then, as shown in FIGS. 5C and 5D, the proximal end 128 is folded in half once again, with the exception of the proximal-most segment 128*a*, thereby causing the proximal tip 129 to extend beyond the resulting multiple folded segment 130. The proximal tip 129 may then be trimmed if desired, to provide a one inch long enlarged multiple folded conductive segment 130.

A section of shrink tubing or other nonconductive sleeve 40 is disposed over the multiple folded conductive segment 130, similar to the process previously described. The resulting enlarged connector lead 126 has a seven strand hexagonal cross-section, as best seen in FIG. 6, which has an outer dimension similar to that of standard size electrical connectors and/or wiring, e.g., may have an effective wire diameter of about 3 times the original size of the wire. The enlarged connector lead 126 is electrically isolated by the nonconductive sleeve 40 until received, for example in the insulation displacement connector 50, thereby coupling the electrode wire 16 to a terminal 60, and standard external circuitry.

Thus, an enlarged connector in accordance with the present invention allows an electrode wire of between about 36 and about 38 gauge to be increased to the equivalent of between about 24 and about 28 gauge wire. Furthermore, additional folds, and consequently longer wire lengths, may be used similar to the methods described above to increase an electrode wire of between about 40 and about 50 gauge up to between about 24 and about 28 gauge wire, as will be appreciated by those skilled in the art.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

What is claimed is:

1. An apparatus for connecting a small diameter wire to a standard size electrical connector, the small diameter wire having a substantially smaller diameter than a standard wire that may be securely received in the connector, comprising:

an enlarged conductive region formed on an end of the small diameter wire, the conductive region having an outer dimension that can be securely received in the connector; and a nonconductive sleeve surrounding and substantially electrically isolating the enlarged conductive region, the nonconductive sleeve being penetrable to electrically couple the enlarged conductive region to the connector.

2. The apparatus of claim 1, wherein the enlarged conductive region comprises a multiple folded segment of the end of the small diameter wire.

3. The apparatus of claim 2, wherein the multiple folded segment has a hexagonal cross-section.

4. The apparatus of claim 1, wherein the enlarged conductive region comprises a conductive tube attached to the end of the small diameter wire.

5. A system for connecting a small wire to an insulation displacement connector, comprising:

a conductive tube having an outer dimension that can be securely received by a slotted pin on the connector, the wire having a substantially smaller diameter than the outer dimension of the conductive tube; and a nonconductive sleeve surrounding and substantially electrically isolating the conductive tube, the nonconductive sleeve being penetrable by the slotted pin to electrically couple the conductive tube to a terminal on the connector.

6. The system of claim 5, wherein the wire has a size in a range from about 36 gauge to about 46 gauge.

7. The system of claim 5, wherein the outer dimension of the conductive tube is equivalent to a wire gauge size from about 24 gauge to about 28 gauge.

8. The system of claim 5, wherein the conductive tube has a passage extending therethrough, the wire extending through the passage.

9. The system of claim 5, wherein the conductive tube comprises a hypotube.

10. The system of claim 5, wherein the nonconductive sleeve comprises shrink tubing disposed over the conductive tube.

11. The system of claim 5, wherein the nonconductive sleeve is formed from a material consisting of polyolefin or TEFLON.

12. The system of claim 5, wherein the wire is attached to the conductive tube by soldering, spot welding or crimping.

13. A system for coupling an electrode wire to electrical circuitry, comprising:

an insulation displacement connector having a slot for receiving an insulated wire having a predetermined size, the electrode wire having a size substantially smaller than the predetermined size of the slot, a cover for securing the insulated wire in the slot, and a blade for penetrating insulation on the insulated wire received in the slot to provide an electrical connection between the insulated wire and a terminal on the insulation displacement connector;

an enlarged conductive region formed on an end of the electrode wire, the enlarged conductive region having a size substantially similar to the predetermined size whereby the enlarged conductive region is securely receivable within the slot; and a nonconductive sleeve substantially surrounding the enlarged conductive region.

14. The system of claim 13, wherein the enlarged conductive region comprises a conductive tubular member attached to the end of the electrode wire.

15. The system of claim 14, wherein the conductive tubular member includes a passage through which the electrode wire is received.

16. The system of claim 14, wherein the conductive tubular member is attached to the electrode wire by spot welding, soldering or crimping.

17. The system of claim 14, wherein the conductive tubular member comprises a hypotube having an outer diameter substantially similar to the predetermined size.

18. The system of claim 13, wherein the enlarged conductive region comprises a multiple folded segment of the end of the electrode wire.

19. The system of claim 13, wherein the nonconductive sleeve comprises shrink tubing disposed over the enlarged conductive region.

20. The system of claim 13, wherein the electrode wire has a size in a range from about 36 gauge to about 38 gauge.

21. The system of claim 13, wherein the nonconductive sleeve is penetrable by the blade when the enlarged conductive region is securely received within the slot.

22. The system of claim 13, the connector further comprising a plurality of slots, each slot configured to receive a respective insulated wire of the predetermined size.

23. A method of providing an enlarged connector lead on a proximal end of an insulated wire to facilitate connection of the wire to a standard electrical connector, the wire having a size substantially smaller than a predetermined size wire that can be securely received by the connector, the method comprising:

forming an enlarged conductive region on an end of the wire, the enlarged conductive region having an outer dimension substantially similar to the predetermined size wire; and covering the enlarged conductive region with a nonconductive sleeve to electrically isolate the enlarged conductive region.

24. The method of claim 23, wherein the enlarged conductive region comprises a conductive tubular member.

25. The method of claim 23, wherein the step of forming the enlarged conductive region is formed by inserting the end of the wire into a conductive tubular member.

26. The method of claim 25, comprising the additional step of stripping insulation off of the wire prior to its insertion into the conductive tubular member.

27. The method of claim 25, further comprising attaching the end of the wire to the conductive tubular member by spot welding, soldering, or crimping.

28. The method of claim 23, wherein the enlarged conductive region is covered by:

directing a nonconductive shrink tube over the enlarged conductive region; and heating the shrink tube to envelop the enlarged conductive region therein.

29. The method of claim 23, wherein the enlarged conductive region comprises a multiple folded segment of the wire end.

30. The method of claim 23, wherein the enlarged conductive region is formed by folding the end of the wire back on itself multiple times.

31. The method of claim 30, further comprising trimming a tip segment of the wire end such that the enlarged conductive region has a substantially hexagonal cross-section.

32. A method of coupling a wire electrode lead from an electrophysiology device to electrical circuitry, comprising:

forming an enlarged conductive region on a proximal end of an electrode lead, the enlarged conductive region having a predetermined outer dimension substantially larger than a size of the electrode lead;

covering the enlarged conductive region with a nonconductive sleeve to electrically isolate the enlarged conductive region;

inserting the isolated enlarged conductive region into a connector, the connector having a size that can securely receive a wire having the predetermined outer dimension of the enlarged conductive region therein; and piercing the nonconductive sleeve with the connector to electrically couple the electrode lead to a terminal on the connector.

* * * * *